US006034636A

United States Patent [19]

Saitoh

[11] Patent Number: 6,034,636

[45] **Date of Patent: *Mar. 7, 2000**

[54] PLANAR ANTENNA ACHIEVING A WIDE FREQUENCY RANGE AND A RADIO APPARATUS USED THEREWITH

[75] Inventor: Tetsuya Saitoh, Saitama, Japan

[73] Assignee: NEC Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/915,783

[22] Filed: Aug. 21, 1997

[30] Foreign Application Priority Data

Aug. 21, 1996 [JP] Japan ..... 8-219827

[51] Int. Cl.[7] ..... H01Q 1/38

[52] U.S. Cl. ..... 343/700 MS; 343/846; 343/702

[58] Field of Search ..... 343/700 MS, 846, 343/848, 829, 702; H01Q 1/38

[56] References Cited

U.S. PATENT DOCUMENTS 4,053,895 10/1977 Malagisi ..... 343/700
4,367,474 1/1983 Schaubert et al. ..... 343/700
4,777,490 10/1988 Sharma et al. ..... 343/700 MS

FOREIGN PATENT DOCUMENTS 60-30646 3/1985 Japan .
63-62402 3/1988 Japan .
7-326922 12/1995 Japan .
8-18327 1/1996 Japan .
8-307303 11/1996 Japan .
2216726 10/1989 United Kingdom .

*Primary Examiner*—Hoanganh Le
*Attorney, Agent, or Firm*—Ostrolenk, Faber, Gerb & Soffen, LLP

[57] ABSTRACT

A planar antenna includes a ground plate and a conductive plate arranged in parallel to the ground plate. The conductive plate has a ground terminal at a first position thereof and has a feed terminal at a second position thereof. The planar antenna further includes a frequency change switch which is used to charge the antenna resonance frequency by electrically connecting the conductive plate to the ground plate at a third position which is different from the first and second positions.

14 Claims, 2 Drawing Sheets

PLANAR ANTENNA ACHIEVING A WIDE FREQUENCY RANGE AND A RADIO APPARATUS USED THEREWITH

BACKGROUND OF THE INVENTION

1. Field of the Invention

The present invention generally relates to a radio unit, and in particular to an improvement of a planar antenna for radio apparatuses such as digital mobile telephones and other portable radio transceivers.

2. Description of the Related Art

A planar inverted-F antenna which can be miniaturized has been widely used in mobile communication apparatuses such as portable radio telephones. Since the frequency range which provides acceptable antenna gains is relatively narrow (generally, 4–5%), however, there have been proposed several antenna structures which can be used in a plurality of frequency bands or a wider frequency range. In an example of conventional antennas, two antennas having different resonance frequencies are used to provide two usably frequency bands. In another antenna, the volume of a element is doubled to substantially widen the frequency range.

Further, a patch antenna has been disclosed in Japanese Patent Unexamined publication No. 62-188504. This conventional antenna is provided with an adjuster for connecting two radiation elements or adjusting the amount of overlapped areas of the two radiation elements to achieve a wider frequency range where acceptable antenna gains are obtained.

However, the above conventional antennas need a plurality of radiation elements or the doubled volume of a radiation element. Such a large element cannot be suitable for mobile apparatuses such as portable telephones. On the other hand, the patch antenna needs a mechanical means for moving the radiation elements. Therefore, it is difficult to obtain a stable antenna characteristic and rapid switching of antenna frequency bands. Further, since the large amount of energy is required to move the radiation elements, the power consumption of a portable telephone is increased.

SUMMARY OF THE INVENTION

An object of the present invention is to provide a small-sized planar antenna which can achieve a wide usable frequency range.

Another object of the present invention is to provide a small-size planar antenna which can rapidly select one of a plurality of resonance frequencies with reliability.

Still another object of the present invention is to provide a radio apparatus which uses a small-sized planar inverted F antenna to rapidly select one of a plurality of frequency channels with reliability.

According to the present invention, an antenna resonance frequency is changed by increasing the number of electrical connections of a conductive plate to the ground plate at predetermined positions of the conductive plate. In other words, the planar antenna includes a ground plate and a conductive plate arranged in parallel to the ground plate. The conductive plate has a ground terminal at a first position thereof and has a feed terminal at a second position thereof which is different from the first position. The planar antenna is provided with a frequency changer which changes the antenna resonance frequency by electrically connecting the conductive plate to the ground plate at a third position which is different from the first and second positions.

Therefore, a wider frequency range can be obtained without the conductive plate increasing in area or volume. In the case where the planar antenna is employed in a radio apparatus such as a portable telephone, the radio apparatus can widely change in receiving frequency by the frequency changer. Therefore, it is suitable for a radio communications system in which a plurality of frequency channels in a wide frequency range are selectively changed.

DETAILED DESCRIPTION OF THE PREFERRED EMBODIMENTS

Figure 1A:
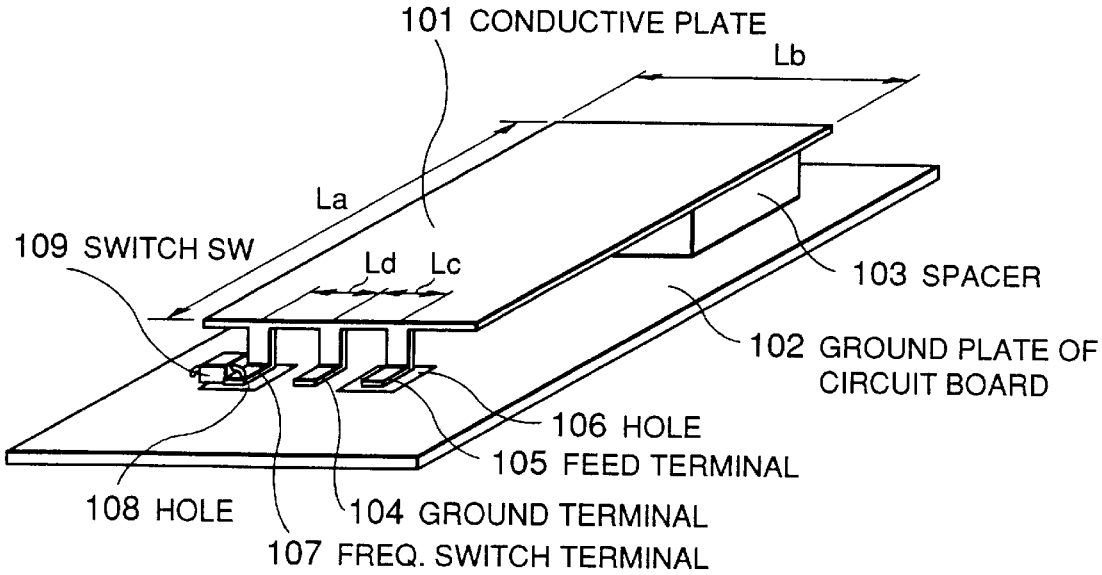
FIG. 1A is a perspective view showing a planar inverted-F antenna according to a first embodiment of the present invention.

Referring to FIG. 1A, there is shown a planar inverted-F antenna having a conductive plate (or a radiation element) 101 which receives radio waves. The conductive plate 101 has a rectangular shape of La×Lb and faces a ground plate 102 in parallel through a spacer 103 made of dielectric. In the case of a portable telephone, the ground plate 102 may be the conducting box of the portable telephone.

The conductive plate 101 is provided with a ground terminal 104 at a predetermined position on a shorter side of the rectangular conductive plate 101. The ground terminal 104 is bent at a right angle to the conductive plate 101 and then the end portion of the ground terminal 104 is further bent at a right angle to form a contact portion parallel to the ground plate 102. The contact portion of the ground terminal 104 is fixed to the ground plate 102 by soldering or the like. Therefore, the conductive plate 101 is stably supported by the spacer 103 and the ground terminal 104.

On the side of the rectangular conductive plate 101, a feed terminal 105 is formed at a distance of Lc from the ground terminal 104. The feed terminal 105 is similarly bent to form a contact portion parallel to the ground plate 102. The contact portion of the feed terminal 105 is electrically connected to a radio receiver (not shown) through a hole 106 formed in the ground plate 102. The hole 106 is designed to avoid the feed terminal 105 from contacting the ground plate 102. The distance Lc is determined so as to match the impedance of the feed terminal 105 to the input impedance of the radio receiver. Needless to said, the position of the feed terminal 105 is not limited to being on the side of the conductive plate 101. It may be provided at a position within the plane of the conductive plate 101.

The conductive plate 101 is further provided with a frequency switch terminal 107 which is formed at a distance of Ld from the ground terminal 104 in the direction opposite to the feed terminal 105. The frequency switch terminal 107 is similarly bent to form a contact portion parallel to the ground plate 102 in which a hole 108 is formed at the position of the contact portion of the frequency switch terminal 107. The contact portion of the frequency switch terminal 107 is connected to the ground plate 102 through a switch 109 which is controlled by a controller. Therefore, when the switch 109 is closed or on, the frequency switch terminal 107 is electrically connected to the ground plate 102 and, when open or off, it is disconnected from the ground plate 102.

The switch 109 is preferably a small-sized switch so as to connect the frequency switch terminal 107 to the ground plate 102 without adding impedance. For example, a reed relay and a small switch mounted in a TO-5 case or the like may be used. Further, in the case where rapid switching is needed, a semiconductor switching device such as a PIN diode switch and a transistor switch may be used.

Figure 1B:
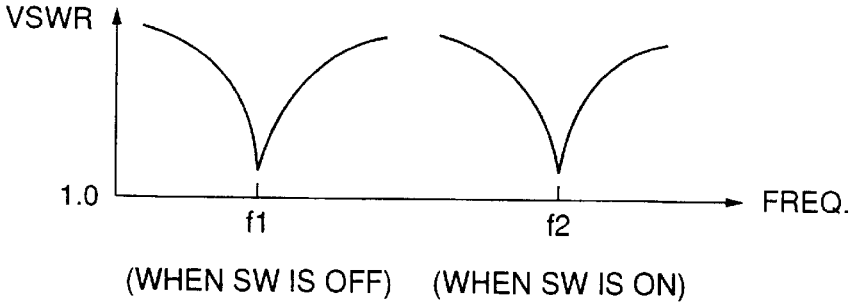
FIG. 1B is a diagram showing a frequency response of voltage standing wave ratio (VSWR) of the planar inverted-F antenna according to the first embodiment.

Referring to FIG. 1B, there is shown a frequency response of the planar inverted-F antenna of FIG. 1A depending on whether the switch 109 is on or off. When the switch 109 is off, an equivalent length L of the circumference of the conductive plate 101 is represented by L=2 La+2 Lb. In this case, the voltage standing wave ratio (VSWR) is minimized when f=f1. In other words, f1 is a first antenna resonance frequency. When the switch 109 is on, the frequency switch terminal 107 is also equivalent length L=2 La+2 Lb−Ld. In this case, the VSWR is minimized when f=f2. The frequency f2 is a second antenna resonance frequency which is higher than the f1 depending on the distance Ld.

Therefore, the longer the distance Ld, the higher the second antenna resonance frequency f2. However, as the distance Ld becomes larger, the radiation pattern of the antenna is deteriorated. Therefore, it is preferable that the distance Ld between the ground terminal 104 and the frequency switch terminal 107 is equal to or less than one third the circumference of the conductive plate 101.

As described above, the antenna resonance can be made at two frequency bands f1 and f1 by controlling the switch 109. Therefore, a wider frequency range can be obtained without the conductive plate 101 increasing in area or volume. In the case where more than two switches 109 are connected at different positions, the antenna resonance is obtained at a plurality of frequency bands, allowing fine changing in antenna resonance frequency. Further, since the on/off control of the switch 109 changes the antenna resonance frequency, rapid frequency changing can be performed with relatively low power consumption and with reliability.

The plan inverted-F antenna as shown in FIG. 1A can be employed in a portable telephone terminal used in a communications system using a plurality of frequency channels such as a TDMA (time division multiple access) mobile communications system where a plurality of predetermined frequency channels are selectively received.

Figure 2:
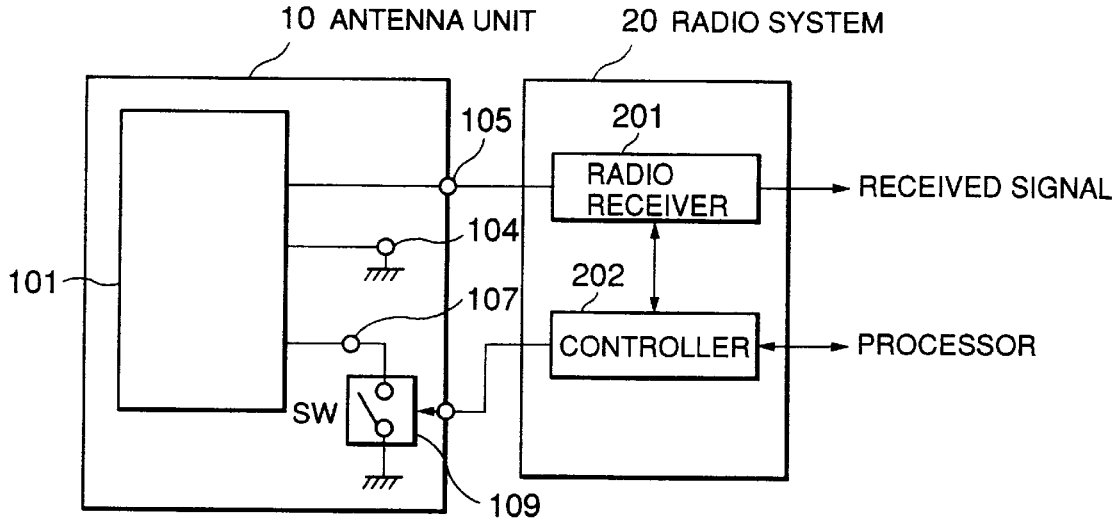
FIG. 2 is a schematic block diagram showing the radio section of a radio apparatus using the antenna unit according to the first embodiment.

Referring to FIG. 2, there is shown a radio apparatus such as a portable telephone which is provided with the planar inverted-F antenna. The radio apparatus is comprised of an antenna unit 10 and a radio system 20. The antenna unit 10 includes the planar inverted-F antenna as shown in FIG. 1A and the radio system 20 includes a radio transmitter (not shown), a radio receiver 201 and a controller 202. The radio receiver 201 receives a radio-frequency signal from the conductive plate 101 of the antenna unit 10 through the feed terminal 105 and then performs frequency-conversion and demodulation to produce a received signal. A processor (not shown) receives the received signal to inform a user of received data through man-machine interface (not shown).

The controller 202 controls the radio receiver 201 and the radio transmitter, and further controls the switch 109 of the antenna unit 10. More specifically, as described before, when the antenna resonance frequency is set to f1, the controller 202 turns the switch 109 off. On the other hand, when the antenna resonance frequency is set to f2, the controller 202 turns the switch 109 on. In this manner, the radio apparatus can widely change in receiving frequency by switching the switch 109 of the antenna unit 10. Therefore, it is suitable for a radio communications system in which a plurality of frequency channels in a wide frequency range are selectively changed.

Figure 3:
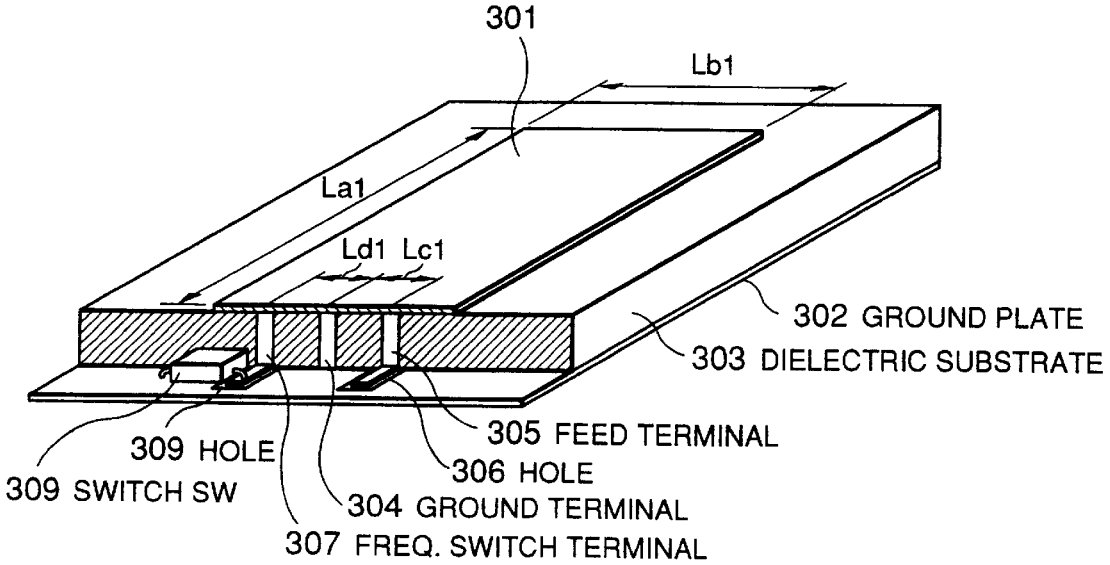
FIG. 3 is a perspective view partly in section, showing a planar inverted-F antenna according to a second embodiment of the present invention.

Referring to FIG. 3, there is shown a planar inverted-F antenna according to a second embodiment of the present invention. The planar inverted-F antenna has a conductive plate (or a radiation element) 301 and a ground plate 302 formed on the respective surface of a dielectric substrate 303 made of insulating material such as Teflon. The conductive plate 302 has a rectangular shape of $La_1 \times Lb_1$. More specifically, the conductive plate 301 and the ground plate 302 are formed by etching metal plates such as copper on the surfaces of the dielectric substrate 303, respectively.

The conductive plate 301 is electrically connected to the ground plate 302 through a ground terminal 304 at a predetermined position on a shorter side of the rectangular conductive plate 301. The ground terminal 304 is formed by a through-hole of the dielectric substrate 303. On the side of the rectangular conductive plate 301, a feed terminal 305 is formed at a distance of $Lc_1$ from the ground terminal 304. The feed terminal 305 electrically connects the conductive plate 301 to a radio receiver (not shown) through a hole 306 formed in the ground plate 302. The hole 306 is designed to avoid the feed terminal 305 from contact with the ground plate 302. The distance $Lc_1$ is determined so as to match the impedance of the feed terminal 305 to the input impedance of the radio receiver. Needless to say, the position of the feed terminal 305 is not limited to being on the side of the conductive plate 301. It may be provided at a position within the plane of the conductive plate 301.

The conductive plate 301 is further provided with a frequency switch terminal 307 which is formed at a distance of $Ld_1$ from the ground terminal 304 in the direction opposite to the feed terminal 305. The ground plate 302 has a hole 308 formed at the position of the end portion of the frequency switch terminal 307 so that the frequency switch terminal 307 is not in contact with the ground plate 302. The frequency switch terminal 307 is connected to the ground plate 302 through a switch 309 which is controlled by a controller. Therefore, when the switch 309 is closed or on, the frequency switch terminal 307 is electrically connected to the ground plate 302 and, when open or off, it is disconnected from the ground plate 302.

As described in the first embodiment, it is also preferable that the distance $Ld_1$ between the ground terminal 304 and the frequency switch terminal 307 is equal to or less than one third the circumference of the conductive plate 301. In the second embodiment, more than two frequency switch terminals may be formed to achieve fine frequency changing. Since the operation of the second embodiment is similar to that of the first embodiment as shown in FIG. 1A, the description of its operation is omitted.

According to the second embodiment as shown in FIG. 3, since the dielectric substrate 303 is sandwiched between the conductive plate 301 and the ground plate 302, the conductive plate 301 reduces in size depending on the dielectric constant $\epsilon_r$ of the dielectric substrate 303. More specifically, when the switch 309 is off, an equivalent length L of the circumference of the conductive plate 301 is represented by L-2 $La_1$+2 $Lb_1$. Therefore, the antenna resonance frequency f1 is a frequency which approximately satisfies the following equation:

$$2\,La_1+2\,Lb_1=\lambda Z\epsilon_r^{1/2},$$

where λ is a wave length corresponding to the antenna resonance frequency f1. Therefore, the size of the conductive plate 301 is smaller than that of the conductive plate 101 of FIG. 1A by $\epsilon_r^{1/2}$. Further, the dielectric substrate 303 stably supports the conductive plate 301 and the ground plate 302, resulting in stable antenna radiation characteristic.

According to the first and second embodiments, the ground terminal, the feed terminal and the frequency switch terminal are connected to the side of the conductive plate. However, these connection positions are not limited to them. They may be provided at positions within the plane of the conductive plate.

What is claimed is:

1. A planar antenna comprising:

a ground plate of a circuit board;

a conductive plate arranged parallel to the ground plate, the conductive plate having a ground terminal at a first position thereof and having a feed terminal at a second position thereof which is different from the first position; and a frequency changer changing an antenna resonance frequency, the frequency changer being disposed electrically between the conductive plate and the ground plate, the frequency changer comprising a switch selectively electrically connecting the conductive plate directly to the ground plate at a third position which is different from the first and second positions.

2. The planar antenna according to claim 1, wherein the third position is provided at a side of the first position opposite to the second position, wherein a distance between the first position and the third position falls within a range which is equal to or smaller than one third a circumference of the conductive plate.

3. The planar antenna according to claim 2, wherein the frequency changer is coupled to the third position, the third position being selectable.

4. The planar antenna according to claim 3, wherein a plurality of third positions are provided and the frequency changer comprises:

a terminal formed at each of the third positions in the conductive plate, the terminal being bent into the ground plate;

a switch selectively switching on and off to electrically connect the conductive plate to the ground plate at each of the third positions.

5. The planar antenna according to claim 4, wherein the switch is one selected from a reed relay, a PIN diode switch and a transistor switch.

6. The planar antenna according to claim 2, wherein the frequency changer comprises:

a terminal formed at the third position in the conductive plate, the terminal being bent to provide a portion adjacent the ground plate;

a switch selectively switching on and off to electrically connect the conductive plate to the ground plate at the third position.

7. The planar antenna according to claim 6, wherein the switch is one selected from a reed relay, a PIN diode switch and a transistor switch.

8. The planar antenna according to claim 1, wherein the ground plate and the conductive plate are partially supported by a dielectric spacer sandwiched between them with a predetermined spacing.

9. The planar antenna according to claim 1, wherein the ground plate and the conductive plate are formed on surfaces of a dielectric substrate by etching metal plates on the sides of the dielectric substrate, respectively.

10. A radio apparatus comprising:

a planar inverted-F antenna; a radio system connected to the planar inverted-F antenna; and a controller controlling a receiving frequency to be received, the planar inverted-F antenna comprises:

a ground plate of a circuit board;

a conductive plate arranged parallel to the ground plate, the conductive plate having a ground terminal at a first position thereof and having a feed terminal at a second position thereof which is different form the first position, the feed terminal being connected to the radio system; and a frequency changer changing an antenna resonance frequency into the receiving frequency, the frequency changer being disposed electrically between the conductive plate and the ground plate, the frequency changer comprising a switch selectively electrically connecting the conductive plate directly to the ground plate at a third position which is different from the first and second positions.

11. The radio apparatus according to claim 10, wherein the third position is provided at a side of the first position opposite to the second position, wherein a distance between the first position and the third position falls within a range which is equal to or smaller than one third a circumference of the conductive plate.

12. The radio apparatus according to claim 11, wherein the receiving frequency to be received is one of a plurality of receiving frequencies, wherein the frequency changer is coupled to third position, the second position and the third position corresponding to the receiving frequencies, the third position being selectable.

13. The radio apparatus according to claim 12, wherein a plurality of third positions are provided and the frequency changer comprises:

a terminal formed at each of the third positions in the conductive plate, the terminal being bent to provide a portion adjacent the ground plate;

a switch selectively switching on and off to electrically connect the conductive plate to the ground plate at each of the third positions.

14. The radio apparatus according to claim 13, wherein the switch is one selected from a reed relay, a PIN diode switch and a transistor switch.

* * * * *